US007568248B2

(12) United States Patent
Nakayama

(10) Patent No.: US 7,568,248 B2
(45) Date of Patent: Aug. 4, 2009

(54) PILLOW

(75) Inventor: Shinichiro Nakayama, Sagamihara (JP)

(73) Assignee: Kabushiki Kaisha Iken Kougyo, Kanagawa (JP)

( * ) Notice: Subject to any disclaimer, the term of this patent is extended or adjusted under 35 U.S.C. 154(b) by 203 days.

(21) Appl. No.: 10/596,988

(22) PCT Filed: Jul. 13, 2005

(86) PCT No.: PCT/JP2005/012939

§ 371 (c)(1),
(2), (4) Date: Jul. 3, 2006

(87) PCT Pub. No.: WO2006/013708

PCT Pub. Date: Feb. 9, 2006

(65) Prior Publication Data

US 2007/0118991 A1 May 31, 2007

(30) Foreign Application Priority Data

Aug. 4, 2004 (JP) ..... 2004-228068

(51) Int. Cl.
*A47G 9/00* (2006.01)

(52) U.S. Cl. ..... 5/640; 5/636; 5/642

(58) Field of Classification Search ..... 5/630, 5/636, 640, 722, 657, 642
See application file for complete search history.

(56) References Cited

U.S. PATENT DOCUMENTS 1,327,103 A * 1/1920 Knowles ..... 280/32.6
2,668,964 A * 2/1954 Simmons ..... 5/657
3,002,201 A * 10/1961 Nelson et al. ..... 5/640

FOREIGN PATENT DOCUMENTS

| | | |
|---|---|---|
| JP | 47-4263 | 2/1972 |
| JP | 50-33063 | 3/1975 |
| JP | 55-91317 | 7/1980 |
| JP | 58-67214 | 4/1983 |
| JP | 09-276108 | 10/1997 |

* cited by examiner

*Primary Examiner*—Fredrick Conley
(74) *Attorney, Agent, or Firm*—Paul A. Guss

(57) ABSTRACT

The invention provides a pillow capable of having the height thereof adjusted automatically so that the height of the back of the head of a user in a face-up lying position is slightly higher than his/her back, and also capable of having the height thereof varied automatically between a face-up lying position and a side lying position. A hollow portion 8 having a biasing mechanism 9 disposed therein is formed in a head placement member 3, and when the head is placed face-up on the head placement member 3, the hollow portion 8 is depressed so that the distance between the lowermost portion of the head and the bottom member 2 is in the range of 10 mm to 30 mm. The biasing mechanism has X-shaped links 11 disposed laterally spaced apart in the hollow portion 8. Each X-shaped link is composed by pivotally connecting a first link member 12 slanted upward toward the front and a second link member 13 slanted upward toward the rear by an intermediate link shaft 16. The biasing mechanism further comprises a front-side upper connecting member 18 for connecting the front ends of the first link members of the X-shaped links, a rear-side upper connecting member 20 for connecting the rear ends of the second link members of the X-shaped links, and a spring member 21 providing a spring force for approximating the link members of each X-shaped link in the frontward/rearward direction along a line of action in the frontward/rearward direction with respect to the X-shaped links.

15 Claims, 10 Drawing Sheets

PILLOW

TECHICAL FIELD

The present invention relates to a pillow used as bed clothes, and more specifically, to a pillow capable of having its height varied according to the user's sleeping position.

BACKGROUND ART

The most natural and preferable position of a person during sleep is a position in which an upright position is brought down as it is to a face-up lying position. In this state, the back of the head which is the lowest position of the head is placed slightly higher than the back, but the rear side surface of the neck is placed 10 mm to 50 mm higher than the back of the head. Therefore, when the user is taking a face-up lying position, the pillow used as bedclothes should desirably maintain the position of the back of the head to be slightly higher than the back while supporting the neck which is placed higher than the back of the head with appropriate strength.

On the other hand, when the user rolls over during sleep and takes a side lying position, the head will be supported by the shoulder, so the position of the head becomes higher compared to the face-up lying position. Therefore, it is desirable for the pillow to change its height automatically to correspond to the face-up lying position and the side lying position of the user during sleep.

Heretofore, there have been various proposals regarding pillows capable of having its height varied automatically. For example, a pillow is proposed (refer to Japanese Patent Application Laid-Open Publication No. 58-67214) comprising an X-shaped link formed by connecting a link member slanted upward to the right and a link member slanted upward to the left connected via an intermediate pivotable connecting portion enabling the link members to pivot freely and being disposed between a bottom member and a head placement member, with the side on which a crown portion of a head of a user placed on a head placement member is positioned being the rear side and the side on which neck of the user is positioned being the front side, having one end of one of the link members supported rotatably to the bottom member or the head placement member and the other end of the link members engaged slidably in the lateral direction to the head placement member or the bottom member, and further having a tension spring stretched across the upper end of one link member supported rotatably on the head placement member and the upper end of the other link member engaged slidably to the head placement member, so that the X-shaped link is biased toward the upward expanding direction by the tension spring.

There is a description in the above-mentioned publication that when the user places his/her head on the head placement member in a face-up lying position during sleep, the head placement member descends by the load of the head resisting against the biasing force of the tension spring, and on the other hand, when the user rolls over to a side lying position in which the head is supported by the shoulder and the load acting on the head placement member is reduced, the head placement member elevates by the upward biasing force provided to the head placement member by the tension spring via the X-shaped link, and as a result, the pillow can have its height varied automatically according to the position of the user during sleep.

However, there is a drawback in that in order to maintain the head placement member to an elevated position corresponding to the head of the user taking a side lying position resisting against the load of the head, it is necessary to set the upward biasing force at the elevated position of the head placement member to correspond to the load of the head, so that even if the user takes a face-uplying position, the head placement member will not descend responsively, and as a result, load is applied on the neck. Furthermore, there is another drawback according to the prior art pillow mentioned above in that the head placement member is not designed to be depressed by the load of the head, and even when the head placement member is at its most descended position in which the link members of the X-shaped link are folded horizontally, a space corresponding to the width of the link members in the upward/downward direction is formed between the head placement member and the bottom member, so that when the user places his/her head on the head placement member in a face-up lying position, the position of the back of the head is not located at a sufficiently low position. Yet another drawback of the prior art pillow is that since the head placement member is constantly subjected to biasing force in the upward direction, the user must constantly resist against the biasing force in order to maintain the position of the head low, by which load is applied to the neck, causing problems such as stiff shoulders, headache, numbness in the hands and legs, neck pain, sprained neck, and so on.

SUMMARY OF THE INVENTION

In consideration of the above problems, the present invention aims at providing a pillow capable of having its height adjusted automatically so that the height of the back of the head is positioned slightly higher than the back when the user places his/her head on the head placement member in a face-up lying position, and also capable of having the height varied automatically corresponding to when the user places his/her head on the head placement member in a face-up lying position and when the user places his/her head in a side lying position.

Yet another object of the present invention is to provide a pillow in which no unnecessary force is required to maintain the height of the back of the head sufficiently low when the user places his/her head on the head placement member in a face-up lying position, so as to prevent load from being applied on the neck.

In order to achieve the above objects, the present invention provides a pillow including a bottom member and a head placement member disposed above the bottom member, comprising a hollow portion formed in the head placement member designed so that when a head of a user is placed face-up on the head placement member, the head placement member is depressed by the load of the head so that the distance between the lowermost portion of the head on the head placement member and the bottom member is in the range of 10 mm to 30 mm, and a biasing mechanism disposed in the hollow portion so as to bias the head placement member upward, wherein the biasing mechanism comprises, provided the side on which a crown portion of the head of a user placed on the head placement member is referred to as a rear side and the side on which the neck of the user is placed is referred to as a front side, a pair of X-shaped links disposed laterally spaced apart in the hollow portion and each composed of a first link member slanted upward toward the front and a second link member slanted upward toward the rear which are connected pivotably via an intermediate pivotable connecting portion, a front-side upper connecting member for connecting front end portions of first link members of the pair of X-shaped links, a rear-side upper connecting member for connecting rear end portions of second link members of the pair of X-shaped links, and a spring member for providing a spring force for approximating the link members of each X-shaped link in the frontward/rearward direction along a line of action in the frontward/rearward direction with respect to the X-shaped link, so that the pair of X-shaped links are biased toward the upper expanding direction via the spring member.

According to the present invention, the upper area of the hollow portion of the head placement member is supported by both front-side and rear-side upper connecting members. When the user places his/her head in a side lying position on the head placement member, the head placement member will be in a non-depressed condition by the upward biasing force acting on the head placement member by the spring member via the X-shaped links, and the upper area of the hollow portion of the head placement member is elevated to a position corresponding to the head of the user sleeping in a side lying position. At this time, the load required to move the X-shaped link toward the downward contracting direction varies according to the location on which the load operates, and the required load is great when the operating location of the load is positioned at an intermediate portion in the frontward/rearward direction between the front-side and rear-side upper connecting members, and the required load reduces as the location becomes closer to each upper connecting member. This is because as the operation location of the load becomes closer to each upper connecting member, the momentum around the pivotable conecting portion acting on each link member of the X-shaped link through each upper connecting member is increased. When the user rolls over during sleep from a side lying position to a face-uplying position, since during the side lying position the head placement member is maintained in a non-depressed state, the position of the head becomes higher than the neck and the neck is bent, by which the load acting on the front side of the head placement member on which the neck is placed is increased by the muscular reaction force of the neck. Since the front-side upper connecting member is disposed at the front side portion of the head placement member, the load increased by the muscular reaction force of the neck enables the X-shaped links to move highly responsively toward the downward contracting direction, by which the head placement member is depressed.

For reference, if the prior-art X-shaped link composed of the link member slanted upward to the right and the link member slanted upward to the left is used, the lateral intermediate portion of the upper end portions of both link members becomes the load operating position of the head and neck, and since the same area is the position at which the load required to move the X-shaped link to the downward contracting direction is greatest, the X-shaped link will not move highly responsively toward the lower contracting direction even when the load is increased by the muscular reaction force of the neck.

At this time, a momentum caused by the spring force of the spring member acts on the pair of link members of each X-shaped link according to the present invention, and this momentum is equal to the product of the spring force and the distance in the vertical direction between the line of action of the spring force and the pivotable connecting portion of the link members. When the X-shaped link starts moving toward the lower contracting direction, the angle formed by the link member and the line of action of the spring force is reduced, and along with this reduction, the distance between the pair of link members in the frontward/rearward direction is increased and the spring force is increased. However, if the angles formed between the link member and the line of action of the spring force fall within a relatively small angular range, the increase rate of the spring force caused by the reduction of angle is small compared to the rate of reduction of the distance between the line of action of the spring force and the pivotable connecting portion. As a result, the momentum acting on the link member by the spring force, that is, the biasing force toward the upper expanding direction applied to the X-shaped link is reduced as the X-shaped link contracts downward. Accordingly, when the X-shaped link starts moving toward the lower contracting direction by the increase in load caused by the muscular reaction force of the neck portion, the X-shaped link will move until it reaches the maximum contracted condition without stopping in mid course. Therefore, the head placement member will be completely depressed and the distance between the lowermost portion of the head and the bottom member falls within the range of 10 mm to 30 mm, so that the lowermost portion of the head will be slightly higher than the back of the user. When the lowermost portion of the head is at the above-described position, the user will be sleeping in a most natural position in which the upright position is brought down as it is to a face-up lying position. As described, according to the present invention, the height of the pillow is varied automatically to follow the change in sleeping position of the user, according to which the user can sleep comfortably.

Furthermore, when the user sleeps in a face-uplying position and places his/her head on the head placement member, the back of the head which is the lowest portion of the head is generally placed at the center area above the hollow portion of the head placement member. Since the link members of the pair of X-shaped links disposed laterally spaced apart in the hollow portion and the front-side and rear-side upper connecting members are not positioned directly under the area of the head placement member on which the back of the head is placed, it is possible to prevent the user from feeling uncomfortable by the link members or the front-side and rear-side connecting members being in contact with the user's head through the head placement member.

Here, it is desirable that the pivotable connecting portion of the link members of each X-shaped link is disposed at a position offset to the rearward direction from the center position in the frontward/rearward direction of the first link member. According to this arrangement, the frontward/rearward distance between the pivotable connecting portion of the link members and the front-side upper connecting member is increased, and the momentum around the pivotable connecting portion acting on the link member by the downward load applied to the front-side upper connecting member increases. Therefore, by the increase in load by the muscular reaction force of the neck of the user rolling over to a face-up lying position causes the X-shaped links to move toward the lower contracting direction with greater responsiveness, and the following ability of the height variation of the pillow in response to the change in position is improved.

In this case, it is preferable that the front end portion of the first link member of each X-shaped link is positioned frontward than the front end portion of the second link member. According to this arrangement, the downward load applied on the front-side upper connecting member causes a momentum that operates in the direction rotating the whole X-shaped links upward in the rear direction with the front-end portion of the second link member acting as the supporting point, so that the rear end portion of the first link member rises up from the bottom member. At this time, if the X-shaped links move to the lower contracting direction, the rear end portion of the first link member will be displaced rearward with respect to the bottom member, but if resistance to this displacement is received from the bottom member, the X-shaped links are prevented from moving toward the contracting direction. However, if the rear end portion of the first link member rises up from the bottom member as mentioned above, the rear end portion of the first link member can be displaced rearward with respect to the bottom member without receiving resistance from the bottom member, and the X-shaped links will move smoothly to the contracting direction.

Moreover, it is preferable that the spring member is composed of a plurality of tension springs which are laterally spaced apart and stretched across the front-side upper connecting member and the rear-side upper connecting member. According to this arrangement, the upper area of the hollow portion of the head placement member is supported elastically via tension springs. Therefore, when the user is in a side-lying position and the head placement member is in a non-depressed state, the portion of the head placement member on which the head of the user is placed (center portion in the upper area of the hollow portion) is depressed between the front and rear upper connecting members, and prevents the position of the head from being lowered.

In order to maintain the head placement member in a non-depressed state when the user is in a side-lying position, it is necessary to apply a biasing force to the X-shaped links toward the expanding direction corresponding to the weight of the head of the user. If the spring force of the spring member is set strong to correspond to a user having a heavy head, even if the biasing force in the expanding direction reduces with the contraction of the X-shaped links, the biasing force toward the expanding direction when the X-shaped links are at their maximum contracted state (when the head placement member is at a completely depressed state) will not be small enough, and a load is applied on the neck of the user in a face-uplying position. If the distance in the vertical direction between the line of action of the spring force of the spring members and the pivotable connecting portion of the link members of each X-shaped link is set to zero, the biasing force toward the expanding direction of the head placement member in the maximum depressed state will be zero. However, according to this arrangement, the head placement member cannot be returned to the non-depressed state if the user changes his/her position from the face-up lying position to the side lying position, so it is necessary to apply a biasing force in the expanding direction to the X-shaped links even when the head placement member is in a completely depressed state.

In consideration of the above, it is desirable that the biasing mechanism is designed so that during depression of the head placement member, the vertical positional relationship between a line of action of the spring force of the spring member (hereinafter called a first spring member) and the pivotable connecting portion of the link members of each X-shaped link is reversed so that the X-shaped links are biased toward the lower contracting direction by the first spring member, and further comprising a second spring member for re-reversing the vertical positional relationship between the line of action of the spring force of the first spring member and the pivotable connecting portion by biasing the X-shaped links toward the upper expanding direction resisting against the biasing force of the first spring member. According to this arrangement, when the head placement member is in its completely depressed state, the X-shaped link is biased toward the expanding direction by a biasing force corresponding to the difference between the biasing force toward the expanding direction by the second spring member and the biasing force toward the contracting direction by the first spring member. Therefore, even if the spring force of the first spring member is increased so as to ensure the desired biasing force toward the expanding direction when the head placement member is in the non-depressed state, the biasing force toward the expanding direction of the head placement member in the completely depressed state can be made sufficiently small, preventing load from being applied on the neck of a user in a face-up lying position, and at the same time, when the user changes his/her position from the face-up lying position to the side-lying position and the load acting on the head placement member is reduced since the head is supported on the shoulder, the head placement member returns infallibly to the non-depressed state.

In this case, it is possible to arrange the second spring member so that the second spring member applies the biasing force in the expanding direction to the X-shaped links only when the vertical positional relationship between the line of action of the spring force of the first spring member and the pivotable connecting portion of the link members of each X-shaped link is reversed. However, more preferably, the pillow should comprise a rear-side lower connecting member for connecting the rear end portions of the first link members of the X-shaped links, a front-side lower connecting member for connecting the front end portions of the second link members of the X-shaped links, an upper tension spring stretched across the front-side upper connecting member and the rear-side upper connecting member, and a lower tension spring stretched across the front-side lower connecting member and the rear-side lower connecting member, wherein the first spring member is composed of one of either the upper tension spring or the lower tension spring, and the second spring member is composed of the other tension spring. According to this arrangement, in the state prior to the reversing of the vertical positional relationship between the line of action of the spring force of the first spring member and the pivotable connecting portion of the link members of each X-shaped link, that is, in the non-depressed state of the head placement member, the X-shaped links are biased toward the expanding direction by the resultant force of the biasing force by the first spring member and the biasing force by the second spring member, so that the necessary biasing force toward the expanding direction to maintain the head placement member at a non-depressed state is obtained even when the spring forces of the first and second spring members are set relatively small. As a result, it becomes possible to prevent the strain of the upper and lower connecting members by the spring force without having to increase the rigidity of the connecting members so much, so the weight of the connecting members can be reduced, and further, the weight of the pillow can be reduced.

Furthermore, if at least one connecting member out of the front-side upper connecting member, the rear-side upper connecting member, the front-side lower connecting member and the rear-side lower connecting member is formed of a shaft-like member capable of being rotated for adjustment, and an end portion of the corresponding tension spring of the upper and lower tension springs is wound around and fixed to the shaft-like member, it becomes possible to easily adjust the biasing force applied to the X-shaped link toward the expanding direction in the non-depressed condition of the head placement member to correspond to the weight of the user's head by rotating the shaft-like member for adjusting the spring force of the tension spring.

Moreover, if the pillow comprises at least one of a rear-side lower connecting member for connecting the rear end portions of the first link members of the X-shaped links and a front-side lower connecting member for connecting the front end portions of the second link members of the X-shaped links, and having a flexible bridging member stretched across the lower connecting member and the front-side or rear-side upper connecting member on the same side as the lower connecting member, wherein one connecting member out of the lower connecting member and the upper connecting member is formed of a shaft-like member capable of being rotated for adjustment, and an end portion of the bridging member is wound around and fixed to the shaft-like member, the distance between the lower connecting member and the upper connecting member during the non-depressed state of the head placement member, that is, the height of the head placement member, can be adjusted easily corresponding to the user by rotating and adjusting the shaft-like member.

Further, if the pillow comprises a shaft-like member to which the end of the tension spring is wound around and fixed or a shaft-like member to which the end of the bridging member is wound around and fixed as mentioned above, by forming to the head placement member a tool inserting hole opening toward an end portion of the shaft-like member, it becomes possible to rotate and adjust the shaft-like member by inserting a tool through the tool inserting hole without taking the biasing mechanism out of the hollow portion, and the adjusting operation is facilitated even further.

Incidentally, if the components of the biasing mechanism such as the link members and the upper and lower connecting members are in contact with the head placement member and the bottom member, the head placement member or the bottom member may be damaged by the friction with the components. In that case, if the biasing mechanism is covered with a stretchable tube-like cover, the components of the biasing mechanism will not contact the head placement member and the bottom member directly, by which the head placement member and the bottom member are prevented from being damaged and the durability thereof can be improved.

Furthermore, the size of the hollow portion should desirably be designed so that a clearance is formed between the surface of the head placement member and the ears of a user when the head placement member is depressed by the load of the head of a user in a face-uplying position. According to this arrangement, even if the head placement member is depressed, there is still a clearance between the surface of the head placement member and the ears of the user, so that the surface of the head placement member will not contact the ears or flip the ears and cause the user to feel uncomfortable during sleep.

Moreover, the head placement member is desirably formed of a molded member made of soft resin, such as low repulsion urethane foam. In that case, if a communication hole for communicating the hollow portion with the exterior is formed on the upper portion of the hollow portion of the head placement member, the air within the hollow portion blows out to the exterior through the communication hole when the head placement member is depressed, thereby cooling the head.

Moreover, if the head placement member is formed of a molded member made of soft resin, it is desirable that the wall on a front side of the hollow portion is formed so that the cross-sectional shape thereof in the vertical direction during non-depressed state of the head placement member is arced to project toward the front direction. According to this arrangement, when the user is in a face-up lying position and the head placement member is depressed, the wall portion on the front side is crushed to expand in the frontward direction under the neck of the user, and by the wall on the front side, the whole neck can be supported in an ideal state.

Further, if the head placement member is formed of a molded member made of low repulsion urethane foam, when the user in a side lying position or a face-down lying position has his/her face in contact with the head placement member, the user may feel the existence of the link members and the connecting members within the hollow portion via the head placement member, and may feel uncomfortable. In this case, if a backing panel formed of an elastic member that is harder than the low repulsion urethane foam, such as a rubber foam, is laminated on a ceiling surface of the hollow portion of the head placement member, the existence of link members and connecting members will not be noticed so easily.

Furthermore, the head placement member can be formed of a bag-like body filled with at least one material selected from a group consisting of feather, natural fiber, synthetic fiber, inorganic particles, organic particles and fluid.

BEST MODE FOR CARRYING OUT THE INVENTION

Next, the preferred embodiments for carrying out the present invention will be described with reference to the accompanying drawings. FIG. 1 is a perspective view of a pillow according to a first embodiment of the present invention, FIG. 2 is a cross-sectional view taken at line II-II of FIG. 1, FIG. 3 is a cross-sectional view taken at line III-III of FIG. 2, FIG. 4 is a side view showing the operation of a biasing mechanism provided in the pillow according to the first embodiment, and FIGS. 5 through 7 are explanatory cross-sectional views showing the operation of the pillow according to the first embodiment.

As shown in FIG. 1, the pillow 1 according to the first embodiment of the invention comprises a bottom member 2 formed of felt or the like and a head placement member 3 disposed above the bottom member 2, wherein the bottom member 2 and the head placement member 3 are covered with an outer cover fabric 4. The head placement member 3 is formed of a molded member made of low repulsion urethane, and is designed so that the planar shape has a horizontally long, substantially rectangular shape. With a head of a user placed on the head placement member 3, if the side corresponding to the crown portion of the head is called a rear side and the side corresponding to the neck is called a front side, there is a lower ridge portion 5 formed on the rear side and a higher ridge portion 6 formed on the front side of the upper portion of the heat placement member 3, and a saddle portion 7 is formed in the area between both ridges 5 and 6.

The head placement member 3 has a hollow portion 8 formed in the interior thereof, as illustrated in FIGS. 2 and 3. When a head portion H of a user lying face up is placed on the head placement member 3 as illustrated in FIG. 5, the head placement member 3 sinks by the load of the head H so that the distance between the lowermost portion or back of the head B of the head H on the head placement member 3 and the bottom member 2 is within a range of 10 mm to 30 mm. Further, a biasing mechanism 9 is disposed inside the hollow portion 8, and a communicating hole 10 that communicates the hollow portion 8 with the exterior is formed on the upper portion of the hollow portion 8 of the head placement member 3.

The biasing mechanism 9 has a pair of X-shaped links 11 and 11 which are disposed laterally spaced apart in the hollow portion 8. Each X-shaped link 11 is composed of a first link member 12 slanted upward toward the front and a second link member 13 slanted upward toward the rear, which are mutually pivotably connected via a lateral link shaft 16 inserted to bearings 14 and 15 disposed at intermediate portions of the link members 12 and 13. According to the first embodiment, the X-shaped links 11 are disposed along both side walls in the lateral direction of the hollow portion 8.

The biasing mechanism 9 further comprises a rear-side lower connecting member 17 for connecting the rear ends of the first link members 12 and 12 of the two X-shaped links 11 and 11, a front-side upper connecting member 18 for connecting the front ends of the first link members 12 and 12, a front-side lower connecting member 19 for connecting the front ends of the second link members 13 and 13 of the two X-shaped links 11 and 11, and a rear-side upper connecting member 20 for connecting the rear ends of the second link members 13 and 13. Further, the first link members 12 and 12, the rear-side lower connecting member 17 and the front-side upper connecting member 18 are formed as a single component having a shape of a rectangular frame, and similarly, the second link members 13 and 13, the front-side lower connecting member 19 and the rear-side upper connecting member 20 are also formed as a single component having a shape of a rectangular frame.

A first spring member or pair of tension springs 21 and 21 laterally disposed apart is stretched across the rear-side and front-side lower connecting members 17 and 19. Thus, the pair of tension springs 21 and 21 applies spring force in the direction approximating the two link members 12 and 13 of each of the X-shaped links 11 along a line of action in the frontward/rearward directions with respect to the pair of X-shaped links 11. Thereby, a momentum around the link shaft 16 via spring force is applied to the link members 12 and 13, and the momentum applies biasing force to the X-shaped links 11 and 11 toward the upper expanding direction, by which the upper portion of the hollow portion 8 of the head placement member 3 is biased upward via the front-side and rear-side upper connecting members 18 and 20.

Moreover, the biasing mechanism 9 is designed so that when the head placement member 3 sinks as described later, the vertical positional relationship between the line of action of the tension spring 21 and the link shaft 16 functioning as a pivotable connecting portion of the link members 12 and 13 of each of the X-shaped links 11 is reversed, so that X-shaped links 11 and 11 are biased toward the lower contraction direction by the tension spring 21. Actually the rear end portion of the tension spring 21 is engaged to an L-shaped bracket 22 attached to the rear-side lower connecting member 17 at an upper position than the lower connecting member 17. When the X-shaped link 11 is at an expanded state, the center line of the tension spring 21 (line of action of the spring force) is positioned below the link shaft 16, but when the X-shaped link 11 is at its maximum contracted state, as illustrated in FIG. 4(*c*), the center line of the tension spring 21 is displaced to a position above the link shaft 16 by distance M. Further, on the upper surface of the second link member 13 at the front side of each X-shaped link 11 is disposed a second spring member or leaf spring 23 that opposes to the front-side upper connecting member 18. When the X-shaped link 11 is at an extended state, the front-side upper connecting member 18 is disposed away from the leaf spring 23, but when the vertical positional relationship between the center line of tension spring 21 and the link shaft 16 is reversed, the front-side upper connecting member 18 comes into contact with the leaf spring 23, and the leaf spring 23 biases the X-shaped link 11 to the upper expanding direction resisting against the biasing force of the tension spring 21, so that the vertical positional relationship between the center line of the tension spring 21 and the link shaft 16 can be reversed again.

Further, as illustrated in FIG. 4, an extension cloth 24 that contacts the ceiling of the hollow portion 8 is attached between the front-side and rear-side upper connecting members 18 and 20. Moreover, the amount of expansion of the X-shaped link to the upper direction is restricted by a flexible bridging member 25 disposed to extend between the rear-side lower connecting member 17 and upper connecting member 20.

Next, with reference to FIGS. 4 through 7, the height variation of pillow 1 corresponding to the operation of the biasing mechanism 9 and the change in position of the user during sleep will be described. When the user takes a side lying position during sleep (refer to FIG. 6), the head H of the user is supported by his/her shoulder S and the load acting on the head placement member 3 is reduced, so as shown in FIG. 4(*a*), the X-shaped link 11 is expanded toward the upper direction by the biasing force toward the upper expanding direction applied by the tension spring 21, and the upper area of the hollow portion 8 of the heat placement member 3 is pushed up so that the head placement member 3 is in a non-depressed state as shown in FIG. 6.

Now, the load required to move the X-link 11 toward the lower contracting direction differs by the operating position of the load, and when the operating position of the load is positioned in the middle of the frontward/rearward direction between the front and rear upper connecting members 18 and 20, the required load is great, and as the position approximates either of the upper connecting members 18 or 20, the load becomes smaller. This is because as the load operating position approximates the upper connecting members 18 or 20, the momentum around the link shaft 16 acting on each of the link members 12 and 13 of the X-shaped link 11 through the upper connecting members 18 and 20 is increased. The load operating position of the head H of the user taking a side lying position is at the intermediate portion in the frontward/rearward direction between the front and rear upper connecting members 19 and 21, and even if the load of the head acts on this area, the load required to move the X-shaped link 11 toward the lower contracting direction is great, so the head placement member 3 maintains a non-depressed state.

When the user rolls over during sleep and turns from a side lying position to a face-up lying position, since during the side lying position the head placement member 3 is maintained at a non-depressed state, the position of the head portion becomes higher than the neck portion so that the neck portion is bent, and by the muscular reaction force of the neck, the load acting on the front side portion of the head placement member 3 on which the neck portion is rested is increased. Since the front side portion of the head placement member 3 is supported by the upper connecting member 18, the load increased by the muscular reaction force of the neck portion causes a great momentum around the link shaft 16 to the first link member 12, by which the X-shaped link 11 moves highly responsively toward the lower contraction direction as shown in FIG. 4(*b*), and the head placement member 3 is depressed.

At this time, the angular relationship between each of the link member 12 and 13 and the line of action of the spring force of the tension spring 21 is set to be approximately 20 degrees when the head placement member 3 is at a non-depressed state. When the X-shaped link 11 starts to move toward the lower contracting direction, the angle between the link members 12 and 13 and the line of action of the spring force is reduced, and along with this reduction the tension spring 21 is expanded and the spring force is increased, but in the angular range of 20 degrees and below, the increase in spring force due to the angular reduction is very little. On the other hand, the distance between the line of action of the spring force of the tension spring 21 and the link shaft 16 reduces in proportion to the amount of downward contraction of the X-shaped link 11. Therefore, the momentum acting on the link members 12 and 13 (=spring force×distance between line of action of spring force and link shaft 16), that is, the biasing force toward the upper expanding direction applied to the X-shaped link 11 reduces along with the downward contraction of the X-shaped link. Even further, during depression of the head placement member 3, the vertical positional relationship between the line of action of the spring force of the tension spring 21 and the link shaft 16 is reversed, so that even if the load applied by the muscular reaction force of the neck portion is reduced by the depression of the head placement member 3, the X-shaped link 11 will not stop in mid course and moves until it reaches the maximum contracted state shown in FIG. 4(*c*). As a result, the head placement member 3 is depressed completely as shown in FIG. 5, and the distance between the lowermost portion of the head H or back of the head B and the bottom member 2 will fall within the range of 10 mm to 30 mm, or for example, 15 mm.

In this state, the difference in biasing force between the biasing force toward the expanding direction by the leaf spring 23 and the biasing force toward the contracting direction by the tension spring 21 biases the X-shaped link 11 toward the expanding direction. Therefore, even if the spring force of the tension spring 21 is increased so as to ensure the required biasing force toward the expanding direction during the non-depressed state of the head placement member 3, the biasing force toward the expanding direction in the completely depressed state of the head placement member 3 will be sufficiently small. Therefore, the head placement member 3 is maintained at the completely depressed state by the load of the head portion H, and the distance between the back of the head B and the bottom member 2 is maintained within the above-mentioned range, by which the user can sleep in the most natural position. Moreover, in the state shown in FIG. 5, the neck portion N of the user is on the high ridge portion 6 of the head placement member 3, but only the reaction force of the bottom member 2 and the ridge portion 6 of the head placement member 3 acts on the neck portion N, so the neck portion N positioned higher than the back of the head B is supported with appropriate strength.

Furthermore, when the head placement member 3 is depressed, the air in the hollow portion 8 blows out to the exterior through the communicating hole 10. By the blowout air, the head H is cooled, by which the "head-cool, feet-warm"condition is realized. Moreover, the size of the hollow portion 8 is set so that a clearance is formed between a surface 3*a* of the head placement member 3 and ears Y of the head portion H of the user in a face-up lying position when the head placement member 3 is at its fully depressed state, as shown in FIG. 7. Therefore, even when the head placement member 3 is depressed, the surface 3*a* of the head placement member 3 will not contact the ear Y and the ear Y will not be bent thereby, so the sleep of the user will not be interfered. Further, in order to ensure a clearance between the surface 3*a* of the head placement member 3 and the ears Y, the hollow portion 8 should preferably have a length approximately 1.5 to 2 times the length between the left and right ears Y and Y of the user, which is actually a lateral length within the range of 30 cm to 40 cm and a height within the range of 60 mm to 80 mm.

When the user sleeping in a face-up lying position rolls over during sleep and changes to a side lying position, at which position the head H is supported by the shoulder S and the load acting on the head placement member 3 is reduced, the X-shaped link 11 is biased as mentioned earlier to the extending direction by the leaf spring 23 even if the head placement member 3 is in a completely depressed condition, and the X-shaped link 11 moves toward the upper extending direction. Then, the positional relationship in the vertical direction of the line of action of the spring force of the tension spring 21 and the link shaft 16 is reversed again, and thereafter, the biasing force applied from the tension spring 21 to the X-shaped link 11 in the expanding direction enables the head placement member 3 to regain its non-depressed condition illustrated in FIG. 6.

FIGS. 8 through 11 illustrate a pillow according to a second embodiment of the present invention, wherein the components that are equivalent to those of embodiment 1 are denoted with the same reference numbers. In the following, the features of the pillow 1 of the second embodiment that differ from those of the first embodiment will be described.

The first difference is that each link shaft 16 connecting the link members 12 and 13 of each X-shaped link 11 in a pivotable manner is positioned at an offset position toward the rear direction than the center in the frontward/rearward direction of the first link member 12, and the front end portion of the first link member 12 of each X-shaped link 11 is positioned frontward than the front end of the second link member 13. By adopting link shafts 16 that are offset to the rear direction, the distance in the frontward/rearward direction between the link shafts 16 and the front-side upper connecting member 18 is increased, so that when load is applied to the front-side upper connecting member 18, a large momentum around the link shaft 16 acts on the first link members 12, by which the X-shaped links 11 are easily contracted in the downward direction.

In the example illustrated in FIG. 10, the length between the front end of the first link member 12 and the link shaft 16 is 1.5 times greater than the length between the rear end of the second link member 13 and the link shaft 16, and the loads required to move the X-shaped link 11 to the lower contracting direction at each position (interval between the positions is 20 mm) along the frontward/rearward direction are written on the upper side of the X-shaped link 11 of FIG. 10(*a*). According to this example, the load around the direct upper portion of the link shaft 16 is approximately 7 kgf, whereas in the position corresponding to the front-side upper connecting member 18, the load is reduced by approximately 2 kgf, and the required load is 5.1 kgf. At this time, the load acting on the head placement member 3 by the head of the user in a side lying position is approximately 4 kgf, but when the user is in a face-up lying position, the load is increased by the muscular reaction force of the neck, and a load of over 6 kgf is applied to the front-side upper connecting member 18. Therefore, the X-shaped link 11 moves highly responsively to the lower contracting direction, and the following performance of the height variation of the pillow with respect to the change in position is improved.

When each X-shaped link 11 moves toward the downward contracting direction, the rear end portion of the first link member 12 is displaced rearward with respect to the bottom member 2, but if the X-shaped link receives resistance from the bottom member 2 by this displacement, the movement of the X-shaped link 11 toward the contracting direction is blocked. Therefore, if the front end portion of the first link member 12 of each X-shaped link 11 is positioned frontward than the front end portion of the second link member 13, the downward load applied to the front-side upper connecting member 18 provides a momentum to rotate the whole X-shaped link 11 toward the upper rearward direction with the front end portion of the second link member 13 (front-side lower connecting member 19) acting as the supporting point, and the rear end portion of the first link member 12 rises up from the bottom member 2. Thereby, the rear end of the first link member 12 can be displaced toward the rear direction with respect to the bottom member 2 without receiving any resistance from the bottom member 2, and the X-shaped links 11 will move smoothly toward the contracting direction.

The second difference of the pillow 1 according to the second embodiment from the first embodiment is that the pillow 1 comprises, as spring members for biasing the X-shaped links 11 toward the upper expanding direction, upper tension springs 26 stretched across the front and rear upper connecting members 18 and 20 and lower tension springs 27 stretched across the front and rear lower connecting members 17 and 19, and the vertical positional relationship between the center line of the upper tension springs 26 (line of action of the spring force) and the link shafts 16 is reversed during depression of the head placement member 3. Here, each of the link members 12 and 13 is formed of a steel member having an L-shaped cross-section with a rising portion 12*a* or 13*a* disposed at the side edge thereof, and via the rising portions 12*a* and 13*a*, the link members 12 and 13 are connected in pivotable manner by the link shafts 16. Further, at the rear area of the rising portion 12*a* of each first link member 12 is formed a recessed portion 12*b* to which the rear-side upper connecting member 20 enters when the X-shaped link 11 is at its maximum contracted state.

When the head placement member 3 is at its completely depressed state, that is, when the X-shaped links 11 are at their maximum contracted condition, as shown in FIG. 10(*b*), the center line of the upper tension springs 26 positioned above the link shafts 16 is displaced lower than the link shafts 16 by distance M (for example, 10 mm), and the X-shaped links 11 are biased toward the contracting direction by the upper tension springs 26. On the other hand, the vertical positional relationship between the center line of the lower tension springs 27 and the link shafts 16 is not reversed, so that the lower tension springs 27 still apply a biasing force in the expanding direction to the X-shaped links 11 in the maximum contracted state. Then, when the X-shaped links 11 are at their maximum contracted condition, the biasing force toward the expanding direction applied by the lower tension springs 27 is set to be greater than the biasing force toward the contracting direction by the upper tension springs 26, so that the X-shaped links 11 are biased toward the expanding direction by the differential biasing force of the former and latter biasing forces.

The values of upward forces acting on the front-side upper connecting member 18 by the biasing force of the X-shaped links 11 in the expanding direction (equal to the load required to move the X-shaped links 11 toward the contracting direction) at each vertical position (distance between each position is 10 mm) are written on the right side of FIG. 10(*a*). According to this example, the upward force of the upper connecting member 18 at the upper end position (height of 80 mm) is 5.1 kgf, whereas the upward force thereof at the lower end position is 0.75 kgf, which is sufficiently small. Therefore, it is possible to prevent load from being applied on the neck portion of a user in a face-up lying position. Moreover, if the user changes his/her position from a face-up lying position to a side lying position in which the head is supported by the shoulder and the load applied on the head placement member 3 is reduced, the X-shaped links 11 are moved to the upward expanding direction, and the head placement member 3 returns infallibly to the non-depressed state.

When the head placement member 3 is in a non-depressed condition, the X-shaped links 11 are biased to the expanding direction by the resultant force of the biasing force of the upper tension springs 26 and the biasing force of the lower tension springs 27, so that the necessary biasing force in the expanding direction required to maintain the head placement member 3 in the non-depressed condition can be obtained even if the spring forces of the upper and lower tension springs 26 and 27 are relatively small. As a result, even if the rigidity of the upper connecting members 18 and 20 and the lower connecting members 17 and 19 are not especially high, the connecting members 17 through 20 can be prevented from being deflected by the spring force, so the weight of the connecting members 17 through 20 can be reduced, and as a result, the weight of the pillow 1 can be reduced. Further, according to the second embodiment, the upper tension springs 26 are the spring member serving to reverse the vertical positional relationship between the line of action of the spring force and the link shaft 16 during depression of the head placement member 3, but the lower tension springs 27 can also serve as this spring member.

Furthermore, there are multiple upper and lower tension springs 26 and 27 spaced apart and disposed laterally. According to this arrangement, the upper area of the hollow portion 8 of the head placement member 3 is supported elastically via multiple upper tension springs 26. Therefore, when the user is in a side lying position and the head placement member 3 is in a non-depressed condition, the portion of the head placement member 3 on which the head of the user is rested (the center of the upper area of the hollow portion 8) is depressed between the front and rear upper connecting members 18 and 20, by which the position of the head is prevented from being lowered.

Further, it is possible to utilize the leaf spring 23 in the first embodiment instead of the lower tension springs 27 as the spring member for re-reversing the vertical positional relationship between the line of action of the spring force of the upper tension springs 26 and the link shafts 16. In this case, it is possible to omit the front and rear lower connecting members 17 and 19.

The third difference between the pillow 1 of the second embodiment and that of the first embodiment is that the rear-side lower and upper connecting members 17 and 20 are formed of shaft-like members that can be adjusted via rotation. The connecting members 17 and 20 formed of shaft-like members are passed through the rising portions 12*a* and 13*a* of the link members 12 and 13 in pivotable manner, respectively. Then, as shown in FIG. 8, nuts 17*a* and 20*a* are mounted to the connecting members 17 and 20 so as to sandwich the rising portions 12*a* and 13*a* of the link members 12 and 13 from both lateral sides, and regularly, the connecting members 17 and 20 are prevented from rotating by the friction between the nuts 17*a* and 20*a* and the rising portions 12*a* and 13*a*. Further, a tool engagement portion 17*b* formed of a nut fixed to one lateral end of the rear-side lower connecting member 17 is disposed, a tool engagement portion 20*b* is also disposed on the other lateral end of the rear-side upper connecting member 20, and tool inserting holes 28 and 29 are formed on both side walls in the lateral direction of the hollow portion 8 of the head placement member 3, each opening to the engagement portions 17*b* and 20*b*, respectively. Thereby, a tool such as a box spanner is engaged with the engagement portions 17*b* and 20*b* via tool inserting holes 28 and 29, respectively, so as to rotate and adjust the rear-side lower connecting member 17 and the rear-side upper connecting member 20.

Now, the rear end portion of each lower tension spring 27 is wound around and fixed to the rear-side lower connecting member 17. Therefore, by rotating and adjusting the rear-side lower connecting member 17, the spring force of the lower tension springs 27 can be varied, and the biasing force toward the expanding direction applied to the X-shaped links 11 during the non-depressed condition of the head placement member 3 can be adjusted to correspond to the weight of the head of the user. If the upward force acting on the front-side upper connecting member 18 during the non-depressed condition of the head placement member 17 is varied between 5.81 kgf, 5.31 kgf, 4.95 kgf, 4.46 kgf and 3.87 kgf by adjusting the spring force of the lower tension springs 27, the upward force acting on the front-side upper connecting member 18 when the head placement member 3 is in its completely depressed condition is 0.92 kgf, 0.82 kgf, 0.75 kgf, 0.7 kgf and 0.55 kgf, respectively. Thus, during the non-depressed condition of the head placement member 17, even if the upward force acting on the front-side upper connecting member 18 is varied greatly in the non-depressed state of the head placement member 17, the upward force acting on the front-side upper connecting member 18 in the completely depressed state of the head placement member 3 will not vary. Accordingly, even if the upward force acting on the front-side upper connecting member 18 during the non-depressed state of the head placement member 17 is increased to correspond to a user with a heavy head, the upward force acting on the front-side upper connecting member 18 during the completely depressed condition of the head placement member 3 is sufficiently small, preventing the load from being applied on the neck of the user in a face-up lying position.

On the rear-side upper connecting member 20 are wound and fixed the upper ends of bridging members 25 having flexibility whose lower ends are engaged in a relatively rotatable manner to the rear-side lower connecting member 17. Therefore, by rotating and adjusting the rear-side upper connecting member 20, the distance between the lower connecting member 17 and the upper connecting member 20 in the non-depressed state of the head placement member 3, that is, the height of the head placement member 3, can be adjusted easily to correspond to the user. Furthermore, the rear end portions of the upper tension springs 26 are engaged relatively rotatably to the rear-side upper connecting member 20, so that the spring forces of the upper tension springs 26 will not be varied by the rotation of the connecting member 20.

Thus, according to the second embodiment, the biasing force toward the expanding direction acting on the X-shaped links 11 is controlled by rotating the rear-side lower connecting member 17, and the height of the head placement member 3 is adjusted by rotating the rear-side upper connecting member 20, but it is also possible to have the lower ends of the bridging members 25 wound around and fixed to the rear-side lower connecting member 17 while having the rear ends of the upper tension springs 26 wound around and fixed to the rear-side upper connecting member 20, so as to adjust the height of the head placement member 3 by rotating the rear-side lower connecting member 17 and adjust the biasing force toward the expanding direction acting on the X-shaped links 11 by rotating the rear-side upper connecting member 20. Furthermore, it is possible to form the front-side upper and lower connecting members 18 and 19 by adjustable shaft-like members, to have end portions of corresponding tension springs wound around and fixed to one of the upper and lower connecting members 18 and 19, and to have the ends of bridging members stretched across the connecting members 18 and 19 wound around and fixed to the other connecting member.

The fourth difference between the pillow 1 of the second embodiment and that of the first embodiment is that the biasing mechanism 9 is covered with a stretchable pipe-like cover member 30 formed of rubber or the like. According to this example, it is possible to prevent the bottom member 2 and the head placement member 3 from being damaged by the components of the biasing mechanism 9 being in direct contact with the bottom member 2 and the head placement member 3.

The fifth difference between the pillow 1 of the second embodiment and that of the first embodiment is that a front-side wall portion 31 of the hollow portion 8 is formed so that the cross-sectional shape thereof along the perpendicular direction when the head placement member 3 is in a non-depressed condition is arced to protrude in the frontward direction. If the front side of the hollow portion 8 is formed as a vertical wall as in the first embodiment, the wall portion will be compressed vertically when the user is in a face-up lying position. Therefore, even if the head placement member 3 is formed of low repulsion urethane foam material, the repulsive force of the wall portion becomes great and the neck portion is compressed thereby. On the other hand, if the front-side wall portion 31 is formed to have an arc-like cross-section as mentioned above, the front-side wall portion 31 will be pressed under the neck portion and extends toward the front side as shown in FIG. 11 when the user is in a face-up lying position. As a result, the whole neck portion can be supported in an ideal state without being compressed.

Further, according to the second embodiment, the bottom member 2 is formed of a molded member of low repulsion urethane foam similar to the head placement member 3, so that the lower half of the hollow portion 8 is surrounded by the surrounding walls of the bottom member 2. Therefore, the front-side wall portion 31 of the hollow portion 8 is structured by bonding an upper half 31*a* integrated with the head placement member 3 and a lower half 31*b* integrated with the bottom member 2, but it is also possible to have the whole front-side wall portion 31 extend to the lower half portion 31*b* being formed integrally with the head placement member 3. Further, according to FIG. 11, a clearance corresponding to the height of rising portions 12*a* and 13*a* of link members 12 and 13 is formed between the bottom member 2 and the head placement member 3, but the clearance is only formed around the X-shaped link, and there is very little clearance formed between the bottom member 2 and the head placement member 3 at the lateral center portion where the head portion is placed, and the distance between the back of the head and the bottom member 2 falls within the range of 10 to 30 mm.

The sixth difference between the pillow 1 of the second embodiment and that of the first embodiment is that on a ceiling surface of the hollow portion 8 of the head placement member 3 is laminated a backing panel 32 made of an elastic member, such as a rubber foam, which is harder than the low repulsion urethane foam comprising the head placement member 3. If the head placement member 3 is formed of a molded member made of low repulsion urethane foam, when the user takes a side lying position or a face-down lying position so that his/her face is in contact with the head placement member 3, the existence of components of the biasing mechanism 9 in the hollow portion 8 such as the link members 12 and 13 or the upper connecting members 18 and 20 are noticed through the head placement member 3, which makes the user unpleasant. By providing a backing panel 32 mentioned above, the user will not easily feel the existence of components of the biasing mechanism 9, and thus, it becomes possible to prevent the user from feeling unpleasant. Further, since the link members 12 and 13 or the upper connecting members 18 and 20 are not disposed at the area corresponding to the center portion of the ceiling surface of the hollow portion 8 of the head placement member 3, it becomes possible to form the backing panel 32 to have a rectangular annular shape and to not have the backing panel 32 laminated on the center portion of the ceiling surface.

Embodiments have been described above in which the head placement member 3 is made of a molded member formed of low repulsion urethane foam, but the head placement member 3 can also be made of a molded member formed of other soft resin materials, such as a normal urethane foam or a rubber foam. Moreover, the head placement member 3 can be formed of a bag-like body filled with at least one material selected from a group of materials consisting of feathers, natural fibers, synthetic fibers, inorganic particles, organic particles and fluids. Examples of natural fibers include plant fibers such as cotton and silk cotton, animal fibers such as camel and the like, and examples of synthetic fibers include synthetic cotton and the like. Further, examples of inorganic particles include particles of coal, ceramics and natural stones, and examples of organic particles include vegetable particles such as buckwheat chaff and the like, or synthetic resin particles such as plastic beads, plastic pipes and the like. Furthermore, examples of fluids include water, jelly, coolant and the like.

According further to the present embodiment, the head placement member 3 is designed to include at least the front-side ridge portion 6, but the head placement member 3 can be of any shape as long as it includes a biasing mechanism 9 disposed within a hollow portion 8.

DESCRIPTION OF REFERENCE NUMBERS

Figure 1:
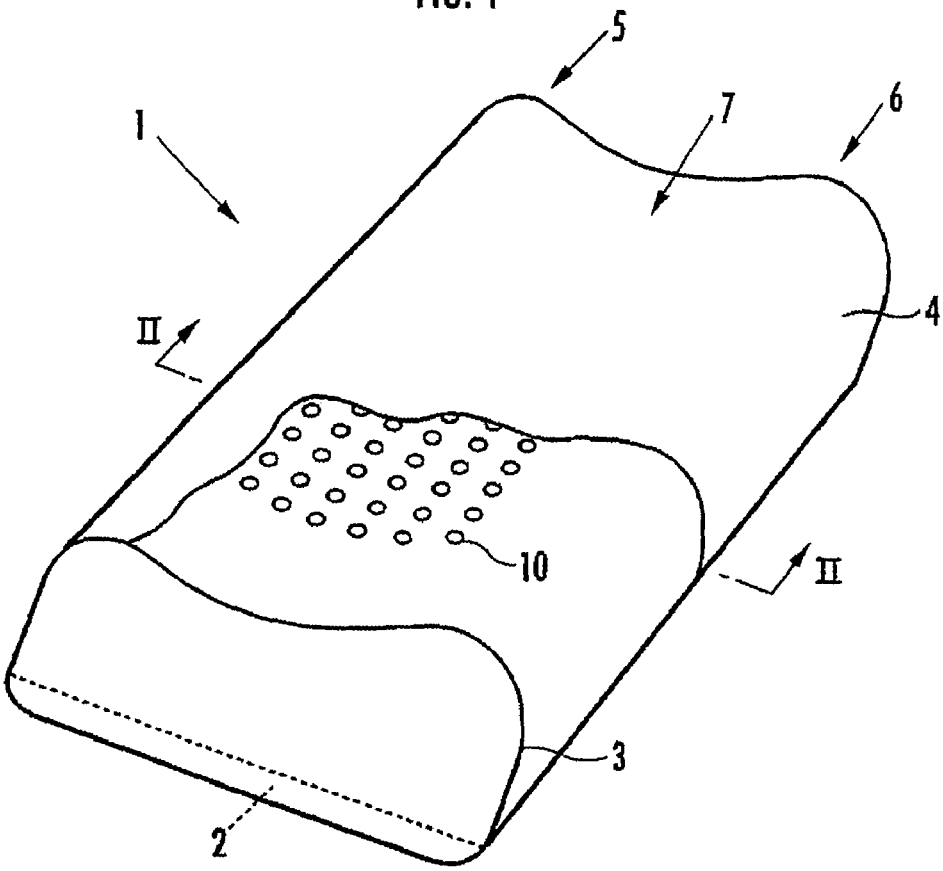
FIG. 1 is a perspective view of a pillow according to a first embodiment of the present invention.
Figure 2:
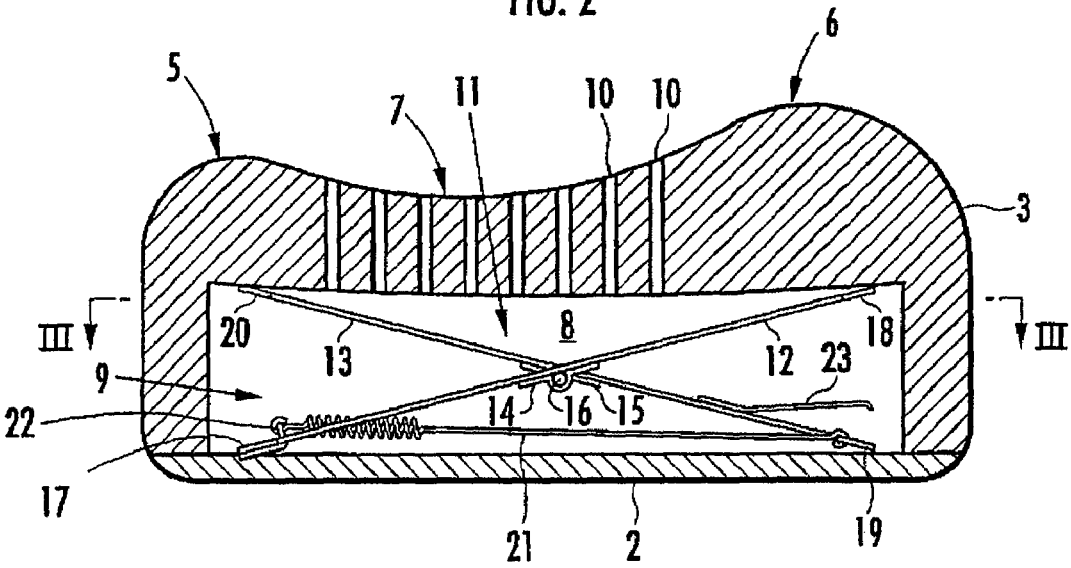
FIG. 2 is a cross-sectional side view cut off at line II-II of FIG. 1.
Figure 3:
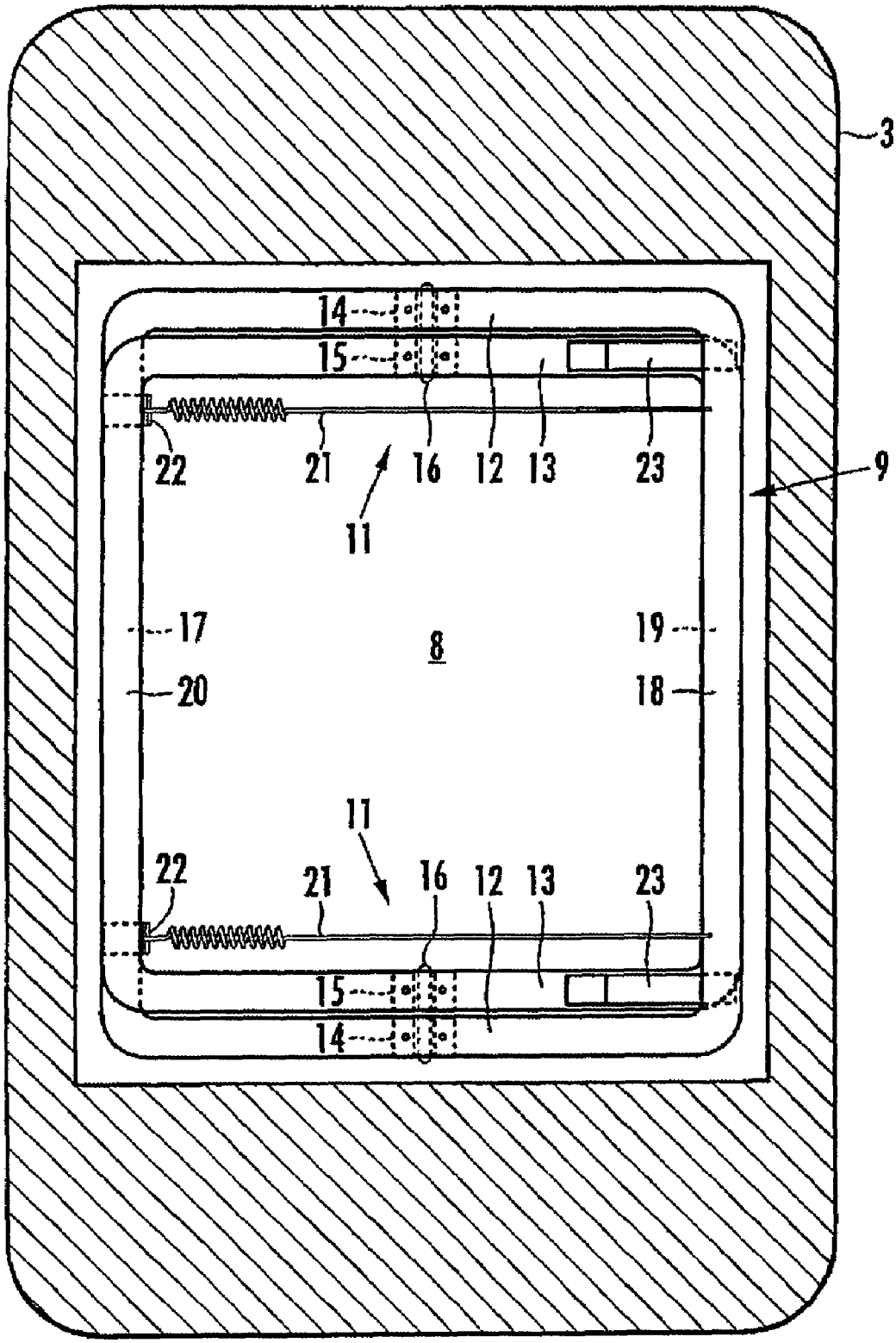
FIG. 3 is a cross-sectional side view cut off at line III-III of FIG. 2.
Figure 4:
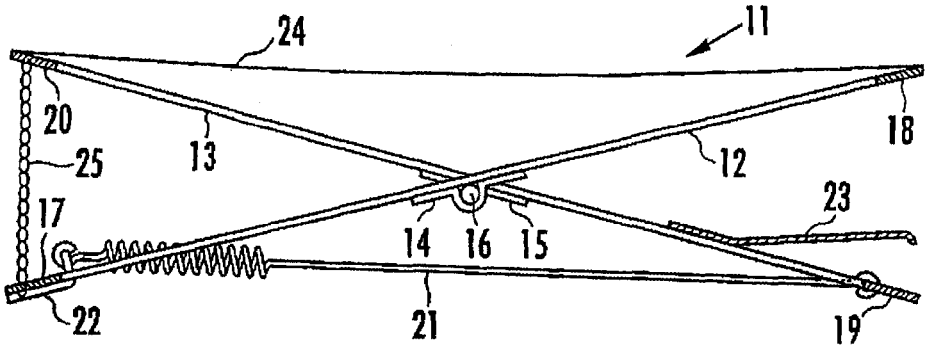
FIG. 4 is a side view showing the operation of a biasing mechanism disposed in the pillow of the first embodiment.
Figure 4:
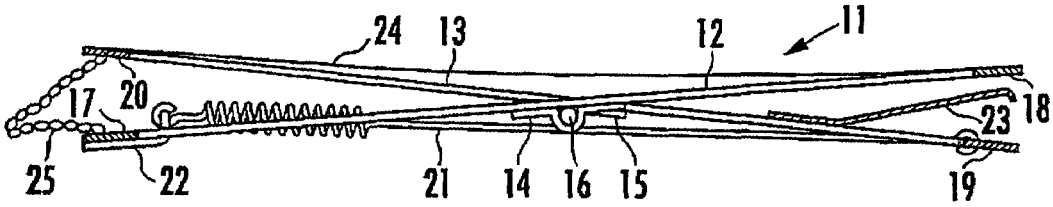
Figure 4:
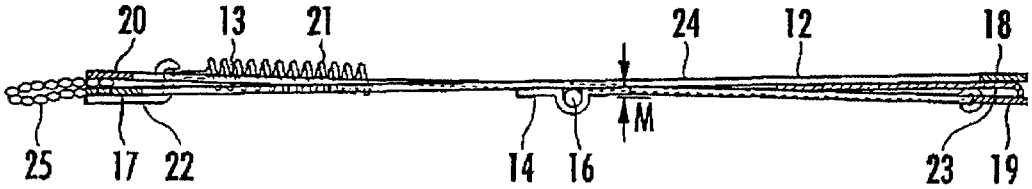
Figure 5:
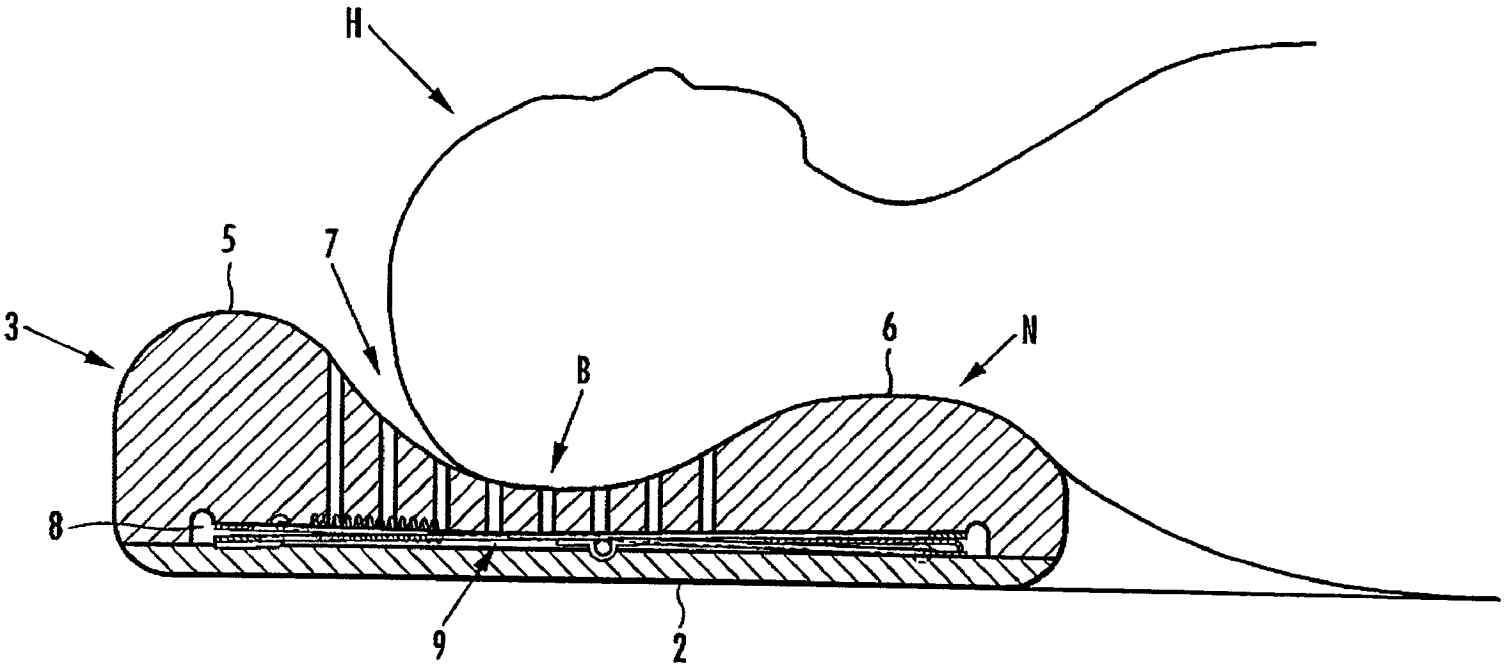
FIG. 5 is a cross-sectional side view showing the pillow on which the head of a user in a face-up lying position is placed according to the first embodiment.
Figure 6:
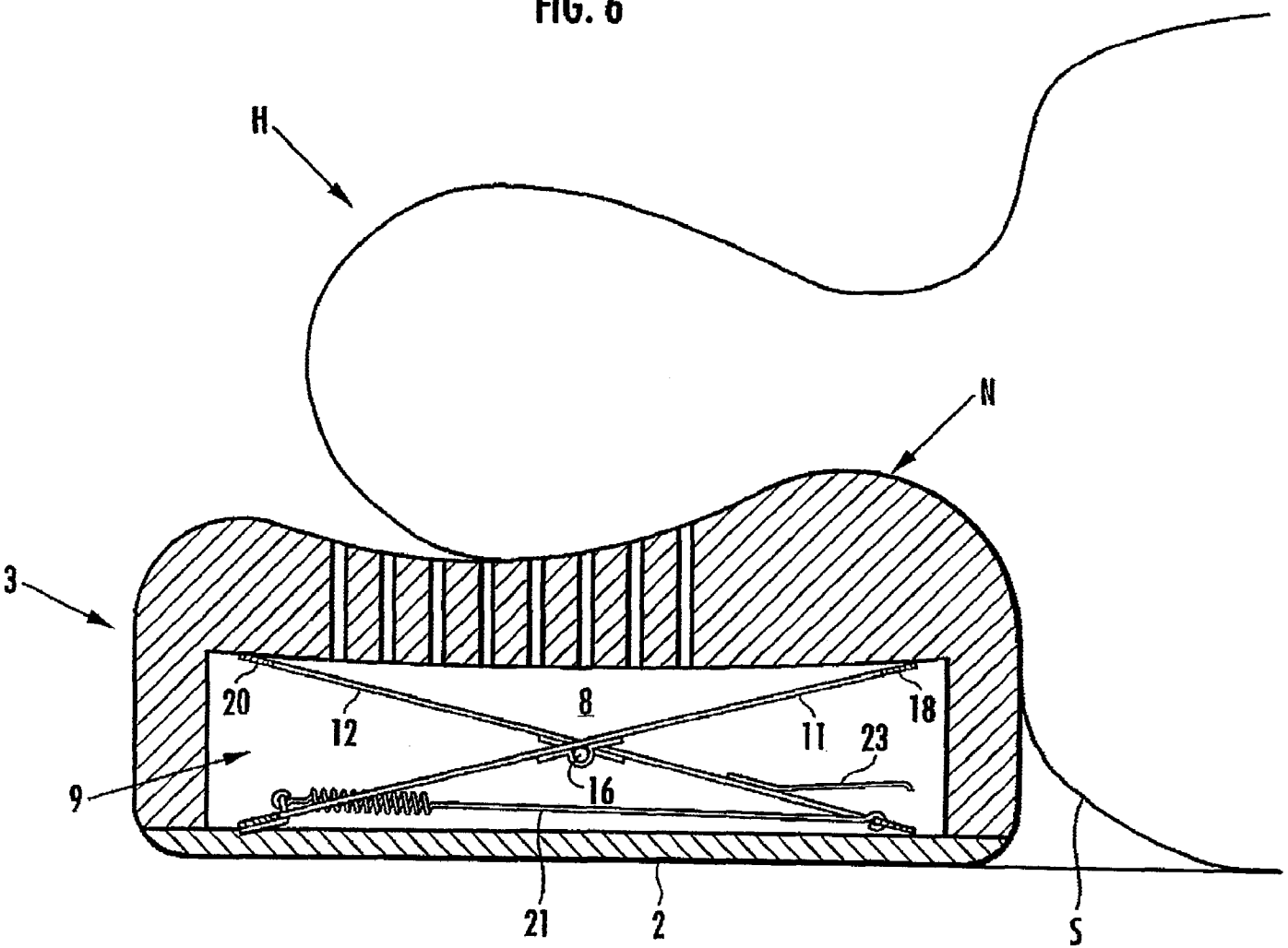
FIG. 6 is a cross-sectional side view showing the pillow on which the head of a user in a side lying position is placed according to the first embodiment.
Figure 7:
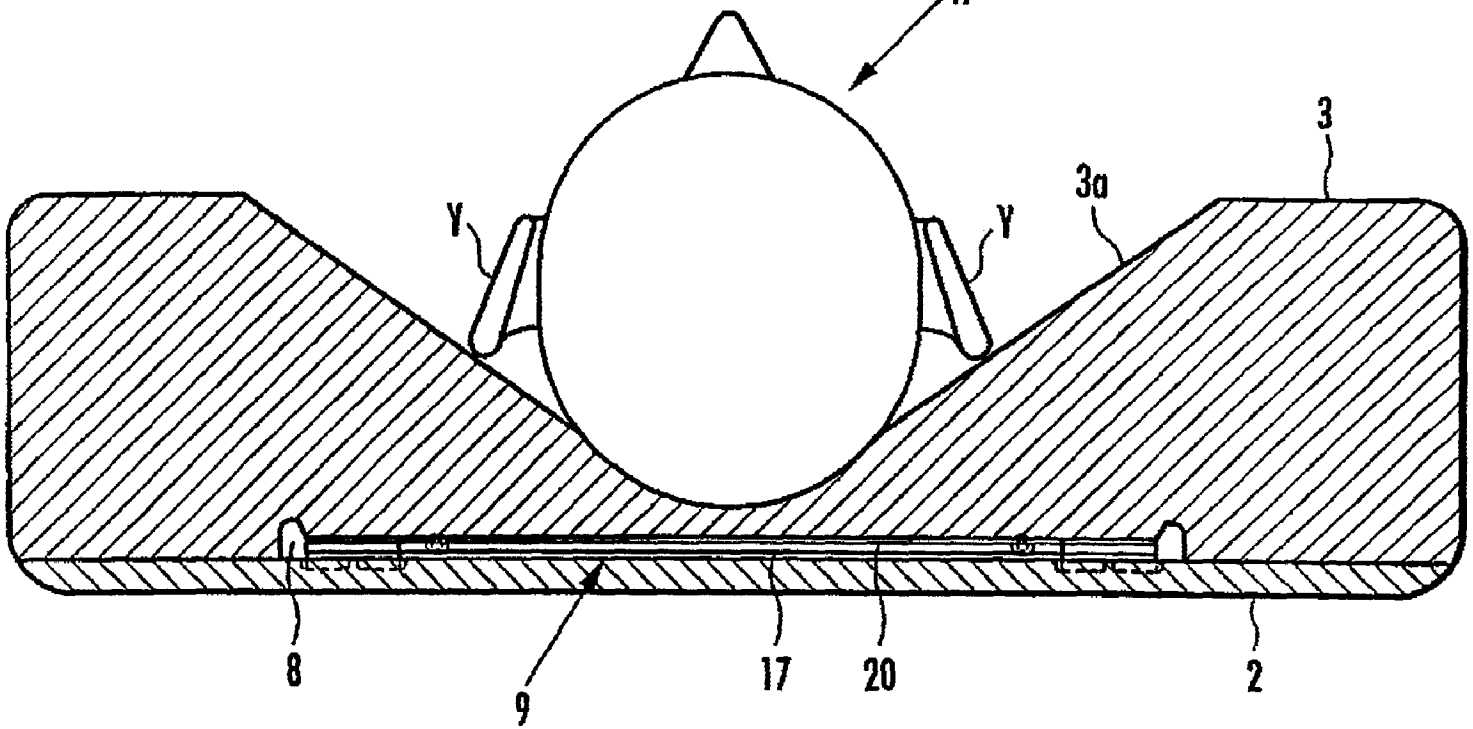
FIG. 7 is a cross-sectional front view showing the pillow on which the head of a user in a face-up lying position is placed according to the first embodiment.
Figure 8:
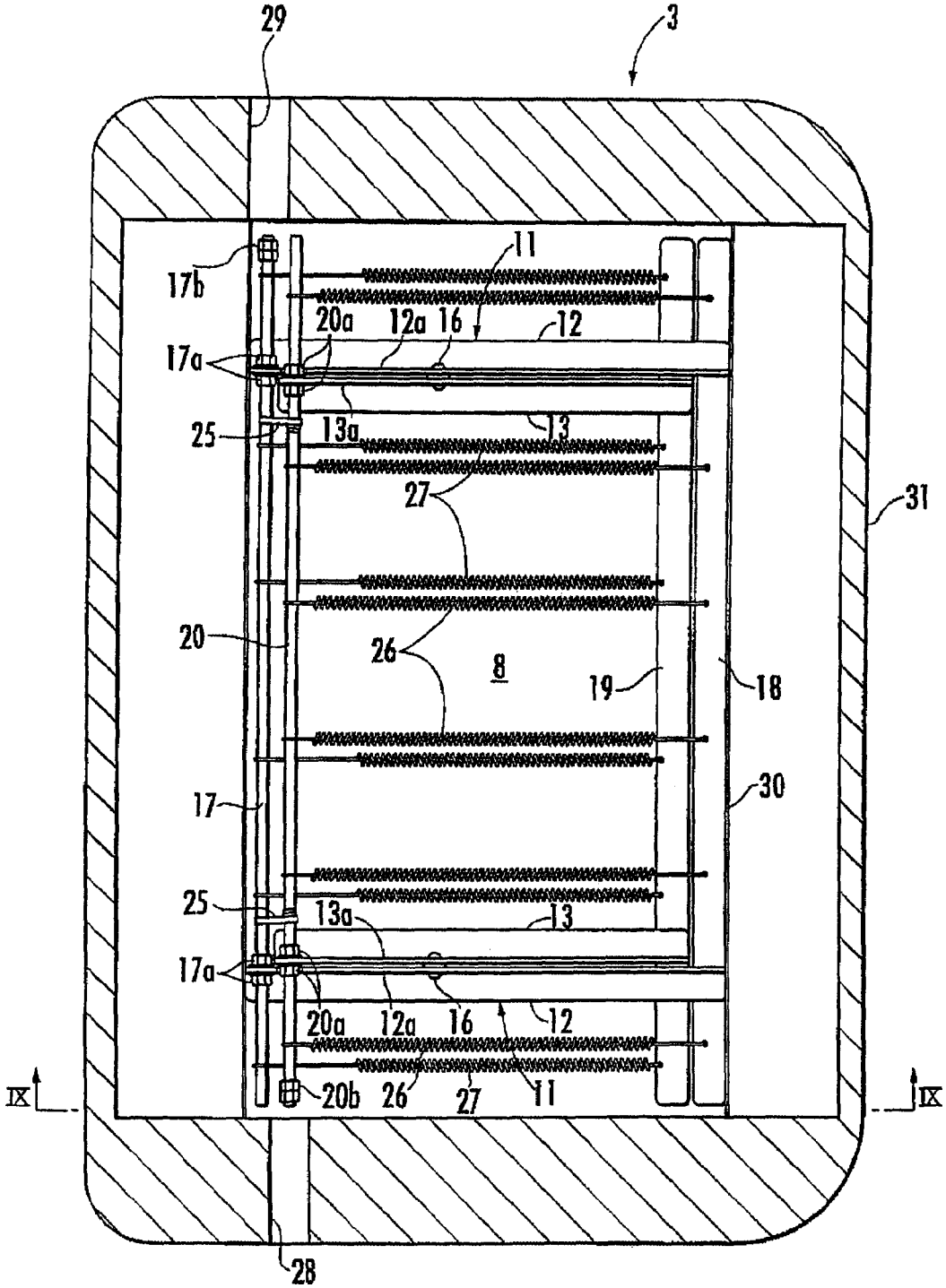
FIG. 8 is a cross-sectional plan view of a pillow according to the second embodiment of the present invention.
Figure 9:
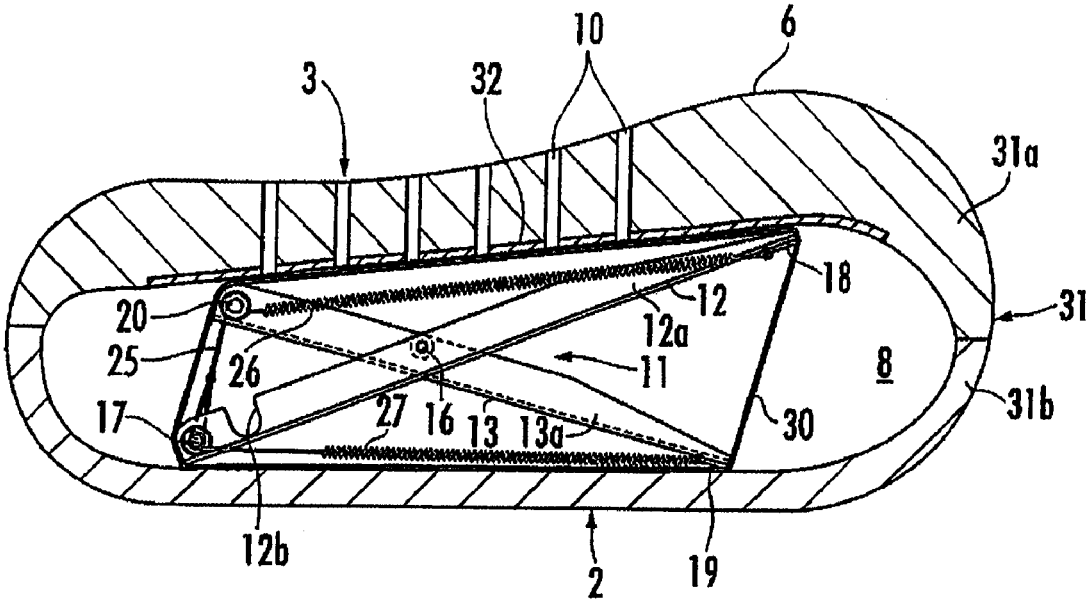
FIG. 9 is a cross-sectional side view cut off at line IX-IX of FIG. 8.
Figure 10A:
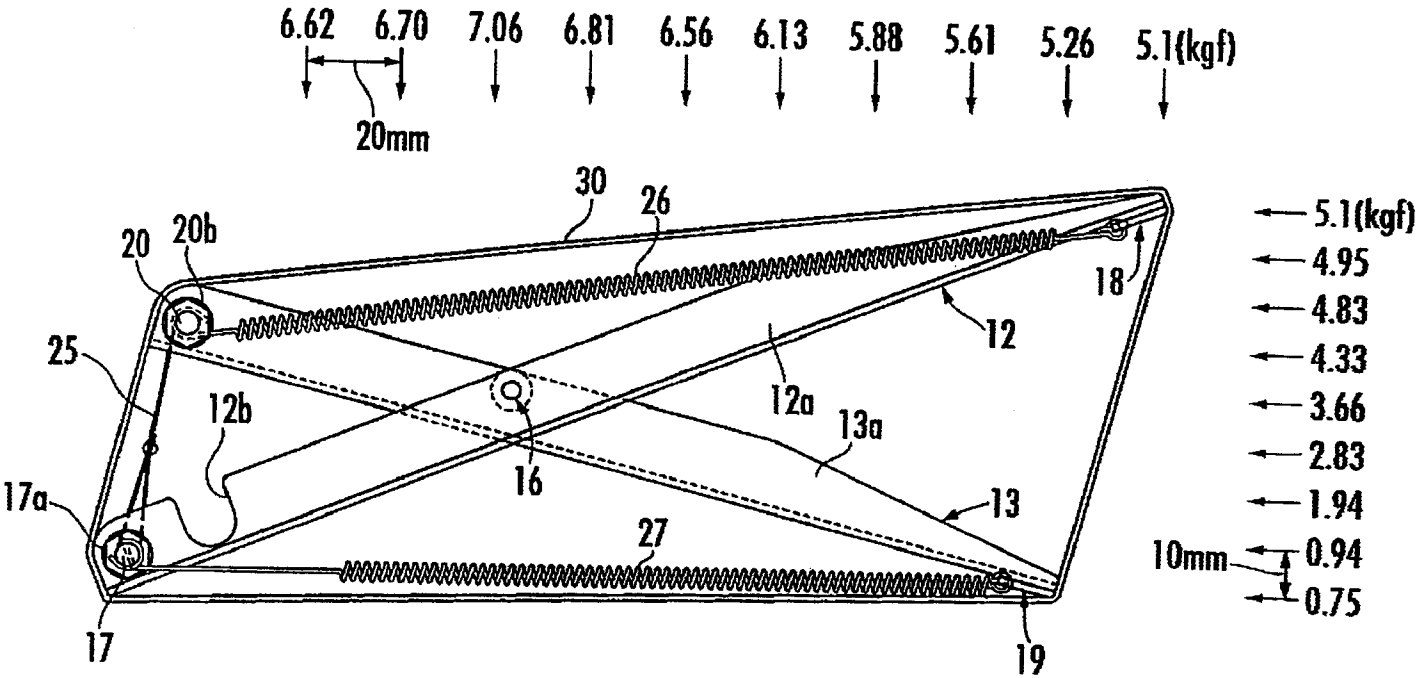
FIG. 10 is a side view showing the operation of a biasing mechanism disposed in the pillow of the second embodiment.
Figure 10B:
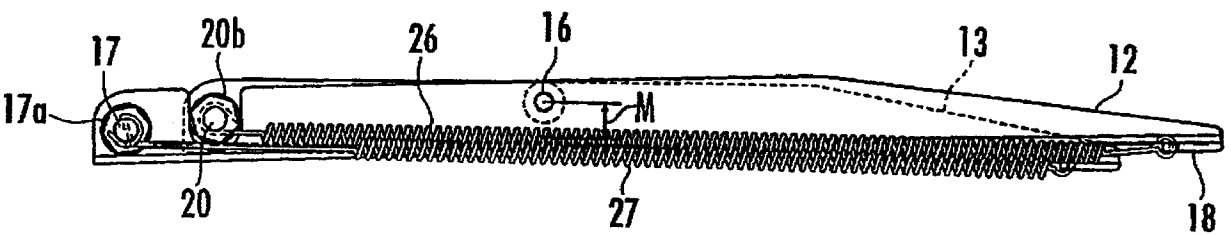
Figure 11:
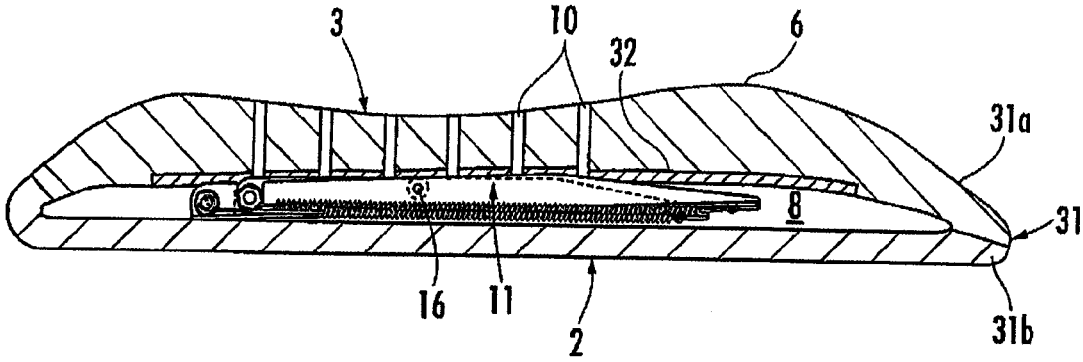
FIG. 11 is a cross-sectional side view showing the depressed state of the pillow according to the second embodiment.

1: pillow, 2: bottom member, 3: head placement member, 8: hollow portion, 9: biasing mechanism, 10: connecting hole, 11: X-shaped link, 12: first link member, 13: second link member, 16: link shaft (pivotable connecting portion), 17: rear-side lower connecting member, 18: front-side upper connecting member, 19: front-side lower connecting member, 20: rear-side upper connecting member, 21: tension spring (spring member), 23: leaf spring (second spring member), 25: bridging member, 26: upper tension spring, 27: lower tension spring, 28,29: tool inserting hole, 30: cover member, 31: front wall portion, 32: backing panel.

The invention claimed is:

1. A pillow including a bottom member and a head placement member disposed above the bottom member, comprising:

a hollow portion formed in the head placement member designed so that when a head of a user is placed face-up on the head placement member, the head placement member is depressed by the load of the head so that the distance between the lowermost portion of the head on the head placement member and the bottom member is in the range of 10 mm to 30 mm; and a biasing mechanism disposed in the hollow portion so as to bias the head placement member upward;

wherein the biasing mechanism comprises, provided the side on which a crown portion of the head of a user placed on the head placement member is referred to as a rear side and the side on which the neck of the user is placed is referred to as a front side, a pair of X-shaped links disposed laterally spaced apart in the hollow portion and each composed of a first link member slanted upward toward the front and a second link member slanted upward toward the rear which are connected pivotably via an intermediate pivotable connecting portion, a front-side upper connecting member for connecting front end portions of first link members of the pair of X-shaped links, a rear-side upper connecting member for connecting rear end portions of second link members of the pair of X-shaped links, and a spring member for providing a spring force for approximating the link members of each X-shaped link in the frontward/rearward direction along a line of action in the frontward/rearward direction with respect to the X-shaped link, so that the pair of X-shaped links are biased toward the upper expanding direction via the spring member, wherein said biasing mechanism is designed so that during depression of the head placement member, a vertical positional relationship between a line of action of the spring force of said spring member and said pivotable connecting portion of the link members of each of said X-shaped links is reversed, so that said X-shaped links are biased toward a lower contracting direction by said spring member, wherein the head placement member is formed of a molded member made of soft resin, and wherein plural communication holes for communicating the hollow portion with the exterior is formed on the upper area of the hollow portion of the head placement member, wherein air within the hollow portion is blown out to the exterior through said communication holes when the head placement member is depressed.

2. The pillow according to claim 1, wherein the pivotable connecting portion of the link members of each X-shaped link is disposed at a position offset to the rearward direction from the center position in the frontward/rearward direction of the first link member.

3. The pillow according to claim 2, wherein the front end portion of the first link member of each X-shaped link is positioned frontward than the front end portion of the second link member.

4. The pillow according to claim 1, wherein the spring member is composed of a plurality of tension springs which are laterally spaced apart and stretched across the front-side upper connecting member and the rear-side upper connecting member.

5. The pillow according to claim 1, further comprising a second spring member for re-reversing the vertical positional relationship between the line of action of the spring force of the spring member and the pivotable connecting portion by biasing the X-shaped links toward an upper expanding direction resisting against the biasing force of said spring member.

6. The pillow according to claim 5, further comprising a rear-side lower connecting member for connecting the rear end portions of the first link members of the X-shaped links, a front-side lower connecting member for connecting the front end portions of the second link members of the X-shaped links, an upper tension spring stretched across the front-side upper connecting member and the rear-side upper connecting member, and a lower tension spring stretched across the front-side lower connecting member and the rear-side lower connecting member, wherein the spring member is composed of one of either the upper tension spring or the lower tension spring, and the second spring member is composed of the other tension spring.

7. The pillow according to claim 6, wherein at least one connecting member out of the front-side upper connecting member, the rear-side upper connecting member, the front-side lower connecting member and the rear-side lower connecting member is formed of a shaft-like member capable of being rotated for adjustment, and an end portion of the corresponding tension spring out of the upper and lower tension springs is wound around and fixed to the shaft-like member.

8. A pillow according to claim 7, wherein a tool inserting hole is disposed in said head placement member adjacent to an end of said rotatable shaft, wherein said inserting hole opens toward said end portion of said rotatable shaft.

9. The pillow according to claim 1, further comprising at least one of a rear-side lower connecting member for connecting the rear end portions of the first link members of the X-shaped links and a front-side lower connecting member for connecting the front end portions of the second link members of the X-shaped links, and having a flexible bridging member stretched across the lower connecting member and the front-side or rear-side upper connecting member on the same side as the lower connecting member, wherein one connecting member out of the lower connecting member and the upper connecting member comprises an adjusting mechanism for adjusting a height of said head placement member in a non-depressed state, said adjusting mechanism including a rotatable shaft capable of being rotated to adjust said height, and an end portion of the bridging member is wound around and fixed to said rotatable shaft.

10. A pillow according to claim 9, wherein a tool inserting hole that opens toward an end portion of the shaft-like member is formed to the head placement member.

11. A pillow according to claim 1, wherein the biasing mechanism is covered with a stretchable tube-like cover.

12. A pillow according to claim 1, wherein the size of the hollow portion is designed so as to ensure a clearance between the surface of the head placement member and the ears of a user when the head placement member is depressed by the load of the head of a user in a face-up lying position.

13. A pillow according to claim 1, wherein the soft resin is a low repulsion urethane foam, and a backing panel formed of an elastic member that is harder than the low repulsion urethane foam is laminated on a ceiling surface of the hollow portion of the head placement member.

14. A pillow according to claim 1, wherein the wall on a front side of the hollow portion is formed so that the cross-sectional shape thereof in the vertical direction during the non-depressed state of the head placement member is arced to project toward the front direction.

15. A pillow according to claim 1, wherein the head placement member is composed of a bag-like body filled with at least one material selected from a group consisting of feather, natural fiber, synthetic fiber, inorganic particles, organic particles and fluid.

* * * * *

UNITED STATES PATENT AND TRADEMARK OFFICE

CERTIFICATE OF CORRECTION

PATENT NO. : 7,568,248 B2
APPLICATION NO. : 10/596988
DATED : August 4, 2009
INVENTOR(S) : Shinichiro Nakayama It is certified that error appears in the above-identified patent and that said Letters Patent is hereby corrected as shown below:

On the title page, item [73]:

The following additional assignee should be listed together with Kabushiki Kaisha Iken Kougyo:

Shinichiro Nakayama, Sagamihara-shi (JP)

Signed and Sealed this

Second Day of February, 2010

David J. Kappos

David J. Kappos
*Director of the United States Patent and Trademark Office*